United States Patent [19]

Matsuoka

[11] 4,364,357

[45] Dec. 21, 1982

[54] AIR-FUEL RATIO CONTROL SYSTEM

[75] Inventor: Tsutomu Matsuoka, Hiroshima, Japan

[73] Assignee: Toyo Kogyo Co., Ltd., Hiroshima, Japan

[21] Appl. No.: 199,041

[22] Filed: Oct. 20, 1980

[30] Foreign Application Priority Data

Oct. 20, 1979 [JP] Japan ..... 54-135768

[51] Int. Cl.[3] ..... F02M 23/04

[52] U.S. Cl. ..... 123/440; 123/489

[58] Field of Search ..... 123/440, 489; 60/276, 60/285; 73/23; 204/195.5

[56] References Cited

U.S. PATENT DOCUMENTS

| | | | |
|---|---|---|---|
| 4,046,118 | 9/1977 | Aono | 123/440 |
| 4,085,716 | 4/1978 | Minami | 123/440 |
| 4,111,170 | 9/1978 | Nakajima et al. | 123/440 |
| 4,119,074 | 10/1978 | Masaki et al. | 123/440 |
| 4,137,877 | 2/1979 | Saito | 123/440 |
| 4,173,956 | 11/1979 | Ikeura et al. | 60/276 |
| 4,306,523 | 12/1981 | Takeda | 123/489 |

FOREIGN PATENT DOCUMENTS

| | | | |
|---|---|---|---|
| 2056723 | 3/1981 | United Kingdom | 123/440 |

*Primary Examiner*—P. S. Lall

*Attorney, Agent, or Firm*—Wenderoth, Lind & Ponack

[57] ABSTRACT

An air-fuel ratio control system for an internal combustion engine including an automobile carburetor having a fuel passage for forming a combustible air-fuel mixture by mixing fuel fed through the fuel passage with air drawn from the atmosphere, comprises a catalytic converter for substantially purifying exhaust gases emitted from the engine, a composition sensor for sensing the concentration of a component of the exhaust gases as a function of the air-fuel mixing ratio of the combustible mixture burned in the engine, a first air bleed passage leading from the atmosphere to the fuel passage, a first actuator for controlling the flow of air through the first air bleed passage, an air-fuel ratio control for controlling the duty ratio of the first actuator in dependence on the output signal fed thereto from the composition sensor, a second air bleed passage leading from the atmosphere to the fuel passage, a second actuator for controlling the flow of air through the second air bleed passage, and an air bleed control for controlling the second actuator to permit the flow of the air to the fuel passage through the second air bleed passage together with the air flowing through the first air bleed passage only when the duty ratio of the first actuator attains a predetermined value.

10 Claims, 11 Drawing Figures

AIR-FUEL RATIO CONTROL SYSTEM

BACKGROUND OF THE INVENTION

The present invention generally relates to an air-fuel ratio control system for adjusting the air-fuel mixing ratio of a combustible air-fuel mixture formed for an automobile internal combustion engine to a predetermined or desired value and, more particularly, to an air-fuel ratio control system effective to carry out the adjustment of the air-fuel mixing ratio on the basis of a feed-back control scheme wherein the concentration of a selected component of exhaust gases emitted from the engine is taken into account in the adjustment of the air-fuel mixing ratio to compensate for change in the air-fuel mixing ratio.

Those skilled in the art are familiar with the fact that, in an automobile exhaust system including a three-way catalytic converter effective to minimize not only CO and HC components but also NOx components of the exhaust gases, the three-way catalytic converter can work at its maximum conversion efficiency if the air-fuel mixing ratio of the combustible mixture to be, or being, supplied to the engine is controlled to a stoichiometric value. A prior art air-fuel ratio control system embodying this concept comprises a composition sensor effective to detect the concentration of a component, for example, oxygen, contained in the engine exhaust gases and to generate an output signal representative of a function of the air-fuel mixing ratio of the combustible mixture burned in the engine, an air-fuel ratio control including a comparator, a proportionating circuit, an integrator, an adder and a duty ratio control circuit and capable of generating an output signal, the magnitude of which is dependent on the output signal from the composition sensor, that is, the concentration of the exhaust gas component, and an actuator provided in an automobile carburetor and operable in response to the output signal from the ratio control circuit to adjust the air-fuel mixing ratio of the combustible mixture being formed in the carburetor.

In this prior art air-fuel ratio control system, where the air-fuel ratio adjustment is carried out by operating the actuator so as to adjust the amount of bleed air to be admixed with fuel before the fuel is mixed with primary air in the carburetor, it is generally considered preferable that the operating range of the actuator, that is, the magnitude of variation in amount of bleed air between the amount of bleed air supplied during the closure of the actuator (the duty ratio being 0%) and the amount of bleed air supplied during the opening of the actuator (the duty ratio being 100%) in the case where the actuator is controlled according to the duty ratio between the open time of the actuator and the closed time of the actuator, should be small in order to attain a precise control of the air-fuel mixing ratio. However, if the above described magnitude of variation is made small, since the combustible air-fuel mixture when the automobile engine is operated at a high altitude and/or under an elevated temperature tends to be enriched due to reduction of the density of atmospheric air with the increased amount of bleed air consequently required, the reference level of the duty ratio (that is, the duty ratio required to maintain the air-fuel mixing ratio at a stoichiometric value) tends to elevate during the condition in which the engine is operated at a high altitude and/or under an elevated temperature, and, if the air-fuel mixture is enriched as a result of a change in engine operating condition, for example, during acceleration, that takes place while the engine is operated at a high altitude and/or under an elevated ambient temperature, any opening of the actuator in an attempt to make the combustible air-fuel mixture leaner does not result in the supply of a sufficient amount of bleed air required to adjust the enriched air-fuel mixture so as to have a mixing ratio equal to the stoichiometric value because the reference level has elevated to such an extent as to reduce the amount of displacement of the reference level towards a level required to make the air-fuel mixture leaner.

On the other hand, the U.S. Pat. No. 4,111,170, patented on Sept. 5, 1978, discloses a technique of adjusting the air-fuel mixing ratio by preventing continuously or in a stepwise fashion air drawn into a carburetor main fuel passage from being undesirably increased with increases in engine load. This patent discloses the use of a controller capable of comparing the output signal from an exhaust composition sensor, which is representative of the sensed air-fuel mixing ratio of the combustible mixture burned in the engine, with a set or desired air-fuel mixing ratio and generating first and second command output signals when the sensed air-fuel mixing ratio is respectively lower and higher than the set or desired air-fuel mixing ratio and a pulse generator operable in response to the first and second command output signals for generating first and second pulse signals, respectively. The first pulse signals are fed to both of first and second electromagnetic flow control valves effective to supply bleed air into the carburetor main and low speed fuel passages, respectively, and are utilized to increase the ratio of the open time of the flow control valves to their closed time to increase the flow of bleed air into the main and low speed fuel passages. On the other hand, the second pulse signals are also fed to the flow control valves, but are utilized to reduce the ratio of the open time of the flow control valves to their closed time in order to reduce the flow of the bleed air into the main and low speed fuel passages.

In any event, the invention of the above mentioned U.S. patent is aimed at solving a problem quite different from that which the present invention is intended to solve, and it is, therefore, believed that the above mentioned U.S. patent is less pertinent to the present invention except for the fact that some component parts of the system of the present invention are disclosed therein.

SUMMARY OF THE INVENTION

The present invention has been developed with a view to substantially eliminating the disadvantages and inconveniences inherent in the prior art air-fuel ratio control system and has for its essential object to provide an improved air-fuel ratio control system effective to control accurately the air-fuel mixing ratio of the combustible air-fuel mixture formed for an automobile internal combustion engine to a predetermined or stoichiometric value required for the catalytic converter to work at its maximum conversion efficiency.

Another important object of the present invention is to provide an improved air-fuel ratio control system of the type referred to above, which is effective to avoid any undesirable variation in air-fuel mixing ratio of the combustible mixture which would result from reduction of the density of atmospheric air, such as occurs when the automobile is running at a high altitude and/or at a place of high temperature.

In order to accomplish these and other objects of the present invention, the present invention is directed to an air-fuel ratio control system for an internal combustion engine including a carburetor having a fuel passage and fuel-air mixing means for forming a combustible air-fuel mixture by mixing fuel fed through the fuel passage with air drawn from the atmosphere, which air-fuel ratio control system comprises a catalytic converter installed on an exhaust passageway leading from the engine to the atmosphere, a composition sensor provided on the exhaust passageway at a position between the engine and the catalytic converter for sensing the concentration of a component contained in exhaust gases emitted from the engine, which concentration is representative of a function of the air-fuel mixing ratio of the combustible mixture burned in the engine, a first auxiliary air bleed passage leading from the atmosphere to the fuel-air mixing means, a first actuator for controlling the flow of air drawn into the fuel-air mixing means through the first auxiliary air bleed passage, and an air-fuel ratio control means for controlling the duty ratio of the first actuator in dependence on the output signal fed thereto from the composition sensor.

In accordance with the present invention, the air-fuel ratio control system of the type referred to above is provided with a second auxiliary air bleed passage leading from the atmosphere to the fuel passage means, a second actuator for controlling the flow of air drawn into the fuel-air mixing means through the second auxiliary air bleed passage, and an air bleed control means for controlling the second actuator to permit the flow of air to the fuel passage means through the second auxiliary air bleed passage together with the air flowing through the first auxiliary air bleed passage only when the duty ratio of the first actuator attains a predetermined value.

One of the first and second auxiliary air bleed passages may be either separate from the other of the first and second auxiliary air bleed passages or a passage portion branched off from the other of the first and second auxiliary air bleed passages.

BRIEF DESCRIPTION OF THE DRAWINGS

These and other objects and features of the present invention will become apparent from the following description taken in conjunction with preferred embodiments thereof with reference to the accompanying drawings, in which:

FIG. 8(*b*) is a diagram showing a waveform of an output signal from an adder shown in FIG. 7;

FIG. 8(*c*) is a diagram showing a relationship between the output signal from the adder and an output signal from another adder, the both being applied to a duty ratio control circuit shown in FIG. 7; and FIG. 8(*d*) is a diagram showing a waveform of an output signal from the duty ratio control circuit shown in FIG. 7.

DETAILED DESCRIPTION OF THE INVENTION

Figure 1:
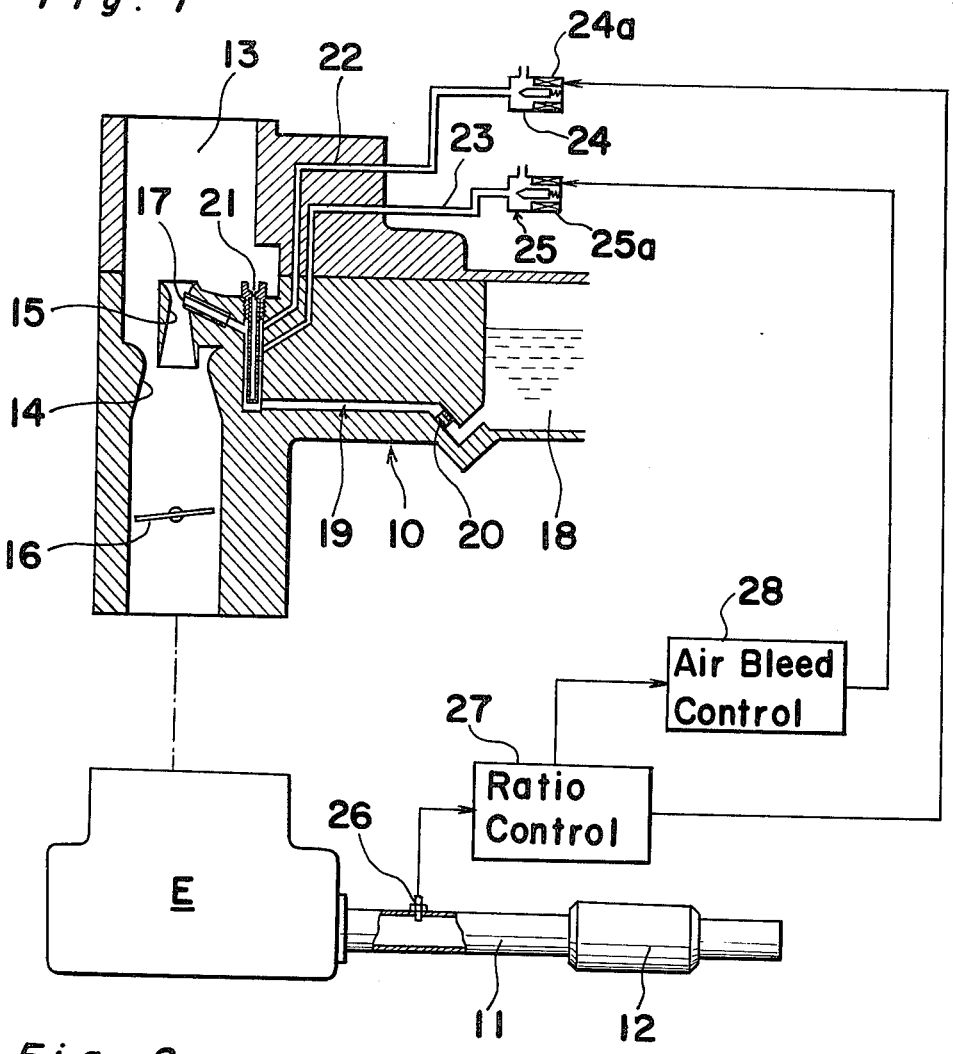
FIG. 1 is a schematic diagram showing an air-fuel ratio control system embodying the present invention, with an essential portion of an automobile carburetor being shown in schematic longitudinal sectional view.

Before the description of the present invention proceeds, it is to be noted that like parts are designated by like reference numerals throughout the accompanying drawings.

Referring first to FIG. 1, there is shown an automobile power plant comprising an internal combustion engine E having a fuel intake system and an exhaust system. The fuel intake system includes a source of combustible air-fuel mixture, that is, a carburetor 10, while the exhaust system includes an exhaust duct 11 having a catalytic converter, for example, a three-way catalytic converter 12, installed thereon.

The carburetor 10 is of any known construction and includes a fuel intake passage 13 having one end communicated to the atmosphere through an air cleaner (not shown) and the other end fluid-connected to the engine E, a primary venturi 14, an auxiliary venturi 15, a throttle valve 16 positioned downstream of the venturies 14 and 15 with respect to the direction of flow of combustible air-fuel mixture towards the engine E, a fuel nozzle 17 opening through the hollow of the auxiliary venturi 15 into the fuel intake passage 13, a fuel bowl 18, a main fuel supply passage 19 having one end opening to the fuel bowl 18 through a metering orifice 20 and the other end opening to the fuel nozzle 17, and a main air bleed port 21 opening to the main fuel supply passage 19 adjacent the fuel nozzle 17. The detailed construction and function of the carburetor 10 so far described are well known to those skilled in the art.

However, in accordance with the present invention, the carburetor 10 also includes first and second auxiliary air bleed passages 22 and 23 opening at one end to the main fuel supply passage 19 adjacent the fuel nozzle 17 and at the other end to respective first and second actuators (electro-magnetically operated flow valves) 24 and 25, each of the first and second actuators 24 and 25 being operable to introduce air from the atomsphere into the corresponding auxiliary air bleed passage 22 or 23 during the opening thereof. Each of the first and second actuators 24 and 25 has a solenoid 24*a* or 25*a* which, when electrically energized, causes the corresponding actuator 24 or 25 to open to introduce the air into the corresponding auxiliary air bleed passage 22 or 23.

In the construction so far described, it will readily be seen that air drawn into the first auxiliary air bleed passage 22 while the first actuator 24 is open is premixed in main fuel supply passage 19 with the fuel flowing from the fuel bowl 18 towards the fuel nozzle 17 through main fuel supply passage 19 and, accordingly, the combustible air-fuel mixture flowing past the throttle valve 16 in the fuel intake passage 13 towards the engine E is relatively lean as compared with that formed by mixing air with fuel while the first actuator 24 is closed. It will also readily be seen that, while the first and second actuators 24 and 25 are both open, the fuel flowing in the main fuel supply passage 19 towards the fuel nozzle 17 is premixed with air drawn from the atmosphere in an amount larger than the amount of air drawn from the atmosphere only through the first air bleed passage 22 while the first actuator 24 is open and, therefore, the combustible air-fuel mixture flowing past the throttle valve in the fuel intake passage 13 towards the engine E is much leaner than that formed by mixing air with fuel while only the first actuator 24 is open. As will become clear from the subsequent description, the second actuator 25 is so controlled as to selectively open and close while the first actuator 24 is open.

A composition sensor 26 of any known construction is installed on a portion of the exhaust duct 11 between the engine E and the catalytic converter 12 for sensing the concentration of a selected component, for example, oxygen, contained in exhaust gases emitted from the engine as a result of and subsequent to the combustion of the combustible air-fuel mixture, the concentration of the exhaust gas component being a function of the air-fuel mixing ratio of the combustible air-fuel mixture which has been burned in the engine E. This composition sensor 26 is capable of generating an output signal indicative of the sensed concentration of the exhaust gas component, which output signal from the composition sensor 26 is supplied to air-fuel ratio control circuitry 27 provided for controlling the duty ratio of the first actuator 24 so that the air-fuel mixing ratio of the combustible mixture to be supplied to the engine E can be controlled in dependence on the concentration of the component contained in the exhaust gases.

The air-fuel ratio control circuitry 27 connected to the first actuator 24 is also connected to the second actuator 25 through air bleed control circuitry 28 operable to detect the duty ratio control signal of the first actuator 24 and to generate, only when the duty ratio so detected of the first actuator 24 attains a predetermined value, a command signal necessary to energize the solenoid 25*a* of the second actuator 25 to open the latter.

Figure 3:
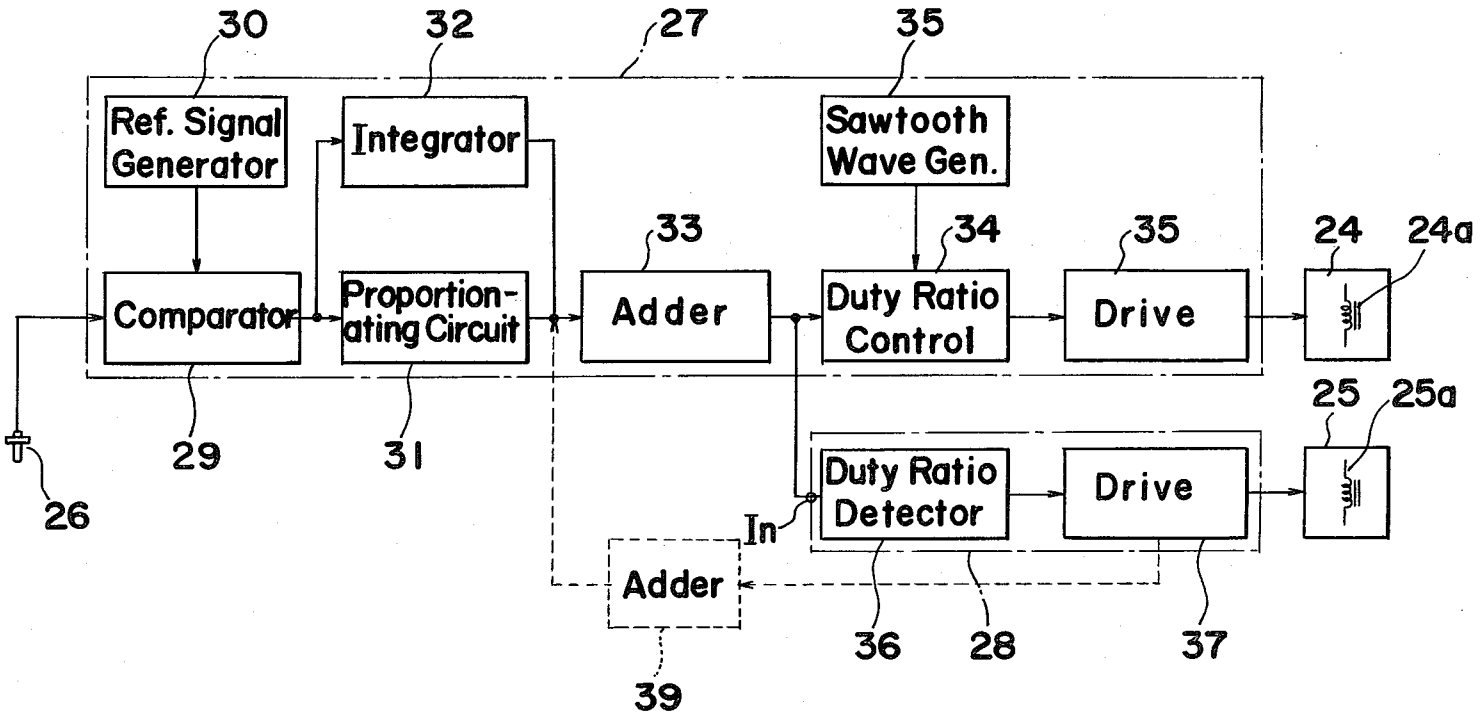
FIG. 3 is a circuit block diagram showing the air-fuel ratio control system according to the first preferred embodiment of the present invention.

Referring now to FIG. 3, the air-fuel ratio control circuitry 27 comprises a comparator 29 for comparing the output signal from the composition sensor 26 with a reference signal fed from a reference signal generator 30, the voltage of said reference signal being representative of the stoichiometric air-fuel mixing ratio of the combustible mixture, and for generating a difference signal indicative of the difference between the output signal from the composition sensor 26 and the reference signal from the reference signal generator 30, a proportionating circuit 31 operable to generate upon receipt of the difference signal from the comparator 29 a proportionated signal proportional to the difference signal, an integrator 32 connected in parallel to the proportionating circuit 31 and operable to integrate the difference signal from the comparator 29, an adder circuit 33 operable to effect an addition of the proportionated signal from the circuit 31 and the integrated signal from the integrator 32 to provide an air-fuel ratio control signal, a duty ratio control circuit 34 for controlling the duty ratio in accordance with the air-fuel ratio control signal fed from the adder circuit 33, a sawtooth wave generator 35 for supplying a sawtooth wave signal to the duty ratio control circuit 34, and a drive circuit 35 for generating a drive or command signal necessary to energize the solenoid 24*a* of the first actuator 24 according to the duty ratio determined by the duty ratio control circuit 34.

The difference signal generated from the comparator 29 is comprised of high and low level signals, the high level signal being generated when the output signal from the composition sensor 26 is higher than the reference voltage set by the reference signal generator 30 while the low level signal is generated when the output signal from the composition sensor 26 is lower than the reference voltage set by the reference signal generator 30.

The integrator 32 when the high level signal is fed thereto from the comparator 29 produces the integrated signal in the form of a first output, the waveform of which is substantially the time integral of the waveform of the high level signal applied and depicts a positive gradient, but produces, when the low level signal is fed thereto from the same comparator 29, the integrated signal in the form of a second output, the waveform of which is substantially the time integral of the low level signal applied and depicts a negative gradient opposite to the positive gradient of the first output. Accordingly, the air-fuel ratio control signal prepared in the adder circuit 33 by summing the integrated signal from the integrator 32 and the proportionating signal (the waveform of the air-fuel ratio control signal from the adder circuit 33 being shown by (a) in FIG. 2, but being subject to variation depending on the nature of the integrated signal applied thereto), has so varying a voltage as to cause the first actuator 24 to make the combustible air-fuel mixture leaner when the concentration of the exhaust gas component sensed by the composition sensor 26 has shown that the air-fuel mixing ratio of the combustible mixture burned in the engine E was lower than the stoichiometric value, and to enrich the same when the detected concentration of the exhaust gas component has shown that the air-fuel mixing ratio of the same was higher than the stoichiometric value.

The duty ratio control circuit 34 serves to superimpose a sawtooth wave signal from the sawtooth wave generator 35 on the ratio control signal from the adder circuit 33 to provide an output signal determinative of the duty ratio of the open time of the first actuator 24, that is, the length of time during which the actuator 24 is opened as a result of energization of the solenoid 24*a*, to the closed time of the same actuator 24, that is, the length of time during which the actuator 24 is closed as a result of deenergization of the solenoid 24*a*. The output signal from the duty ratio control circuit 34 is in turn applied to the drive circuit 35 to produce the command signal necessary to control the operation of the actuator 24 according to the duty ratio. In other words, in the case where the concentration of the exhaust gas component sensed by the composition sensor 26 indicates that the combustible mixture burned in the engine E has been overly enriched in comparison to the stoichiometric air-fuel mixing ratio, the output voltage of the air-fuel ratio control signal, that is, the duty ratio, gradually becomes so high that the open time of the first actuator 24 is prolonged to enable the combustible mixture being supplied to the engine E to become leaner. On the other hand, in the case where the sensed concentration of the exhaust gas component indicates that the combustible mixture burned in the engine E was relatively lean in comparison to the same stoichiometric air-fuel mixing ratio, the output voltage of the air-fuel ratio control signal, that is, the duty ratio, gradually becomes so low that the open time of the first actuator 24 is reduced to enable the combustible mixture being supplied to the engine E to be enriched.

The air bleed control circuitry 28 shown in FIG. 3 comprises a duty ratio detector 36 having an input terminal In connected to the adder circuit 33 and an output terminal connected to the solenoid 25*a* of the second actuator 25 through a drive circuit 37. The duty ratio detector 36 serves to detect the duty ratio of the first actuator 24 on the basis of the air-fuel ratio control signal applied thereto from the adder circuit 33 and to generate an output signal when the duty ratio detected thereby attains a predetermined value. The details of the duty ratio detector 36 and the drive circuit 37 for the second actuator 25 are best shown in FIG. 4, reference to which will now be made.

Figure 4:
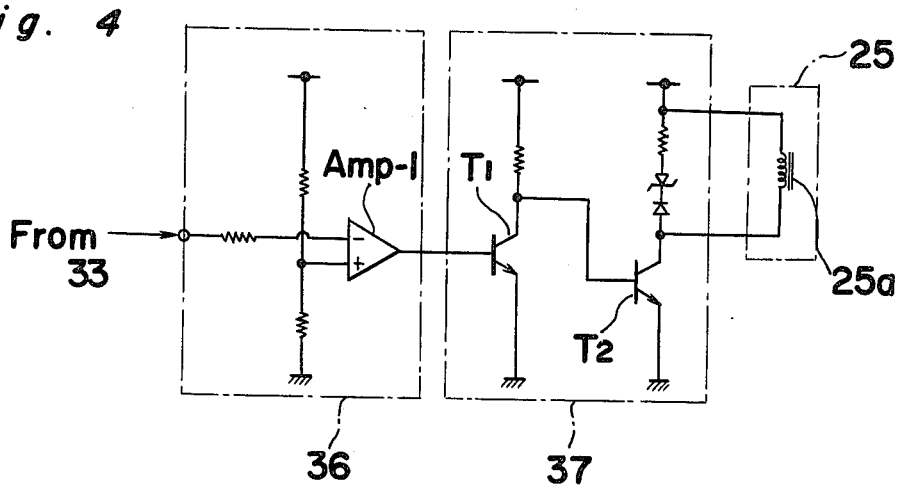
FIG. 4 is a circuit diagram showing the details of the duty ratio detector and a drive circuit both employed in the control system of FIG. 3.

Referring to FIG. 4, the duty ratio detector 36 comprises a differential amplifier Amp 1 having an inverting input terminal adapted to receive the air-fuel ratio control signal from the adder circuit 33 and a non-inverting input terminal adapted to receive a predetermined or reference voltage representative of the predetermined duty ratio. The drive circuit 37 for the second actuator 25 comprises a first switching transistor T1 having its base connected to an output terminal of the differential amplifier Amp 1 of the duty ratio detector 36, and a second switching transistor T2 having its base connected to the collector of the first switching transistor T1 such that the state of the second switching transistor T2 can be reversed when an output from the first switching transistor T1 is applied thereto, said second switching transistor T2 being in turn connected to the solenoid 25*a* of the second actuator 25.

Figure 2:
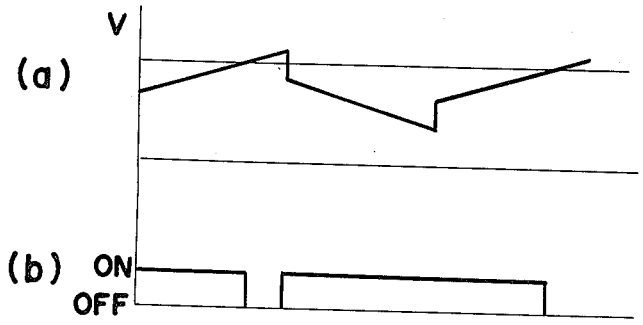
FIG. 2 is a chart showing respective waveforms of output signals from an adder and a duty ratio detector both forming a part of the air-fuel ratio control system according to a first preferred embodiment of the present invention.

The air bleed control circuitry 28 of the construction described above operates in the following manner. Assuming that the air-fuel ratio control signal of the waveform as shown by (a) in FIG. 2 is applied to the duty ratio detector 36 from the adder circuit 33, and only when the voltage of the air-fuel ratio control signal exceeds the reference voltage representative of the predetermined duty ratio, the duty ratio detector 36 generates a low level signal, the output waveform of said detector 36 being shown by (b) in FIG. 2. When this low level signal is applied from the duty ratio detector 36 to the base of the first switching transistor T1 of the drive circuit 37, the first switching transistor T1 is switched off and, consequently, the second switching transistor T2 is switched on to allow the supply of an electric current to the solenoid 25*a* of the second actuator 25, thereby permitting the second actuator 25 to be opened. Accordingly, when the second actuator 25 is opened in the manner described above, the air being supplied to the carburetor main fuel supply passage 19 through the air bleed passage 22 is increased in the admixture with the air drawn from the atmosphere through the air bleed passage 23 past the second actuator 25 then opened and, as a consequence thereof, the air-fuel mixing ratio of the combustible mixture being then supplied towards the engine E is increased.

From the foregoing, it has now become clear that, when the combustible mixture supplied to the engine E is enriched because of the reduction in density of the atmospheric air such as occurring when the engine E is operated at a high altitude and/or under an elevated ambient temperature, the composition sensor 26 detects the richness of the combustible mixture, resulting in increase of the output voltage of the air-fuel ratio control signal to such an extent as to cause the duty ratio of the first actuator 24 to increase. It is also clear that, when the duty ratio so increased exceeds the predetermined value, the solenoid 25*a* of the second actuator 25 is energized to open the second actuator 25 to permit the flow of air towards the carburetor main fuel supply passage 19 through the air bleed passage 23, thereby increasing the amount of air premixed with the fuel. Because the second actuator 25 operates in the above described manner, the air bleed control circuitry 28 can be considered as operating in such a manner as to substantially reduce the duty ratio of the first actuator 24, thereby broadening the operating range of the first actuator 24.

Figure 5:
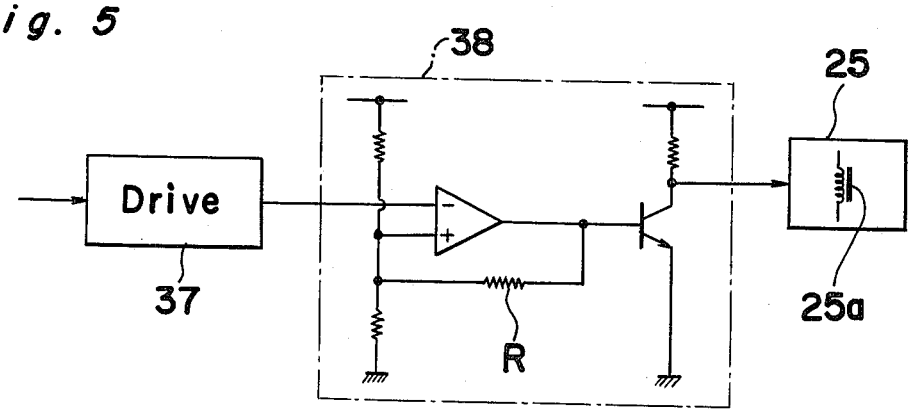
FIG. 5 is a circuit diagram showing an anti-hunting circuit which may be employed in the control system of FIG. 3.
Figure 6:
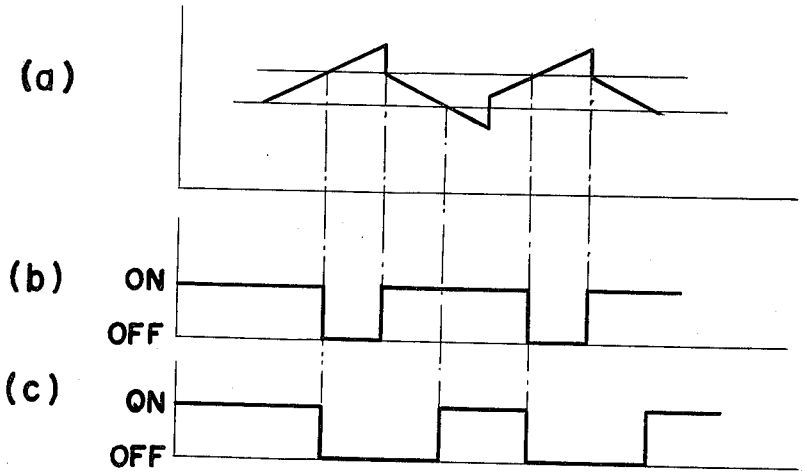
FIG. 6 is a chart showing respective waveforms of output signals from the adder, the drive circuit and the anti-hunting circuit in timed relation to each other.

It is to be noted that, in the construction of the air bleed control circuitry 28 shown in FIGS. 3 and 4, the air bleed control circuitry 28 may have an anti-hunting circuit 38, such as shown in FIG. 5, for imparting a hysteresis characteristic to the predetermined duty ratio of the first actuator 24 which controls the operation of the second actuator 25 so that the predetermined duty ratio at which the solenoid 25*a* of the second actuator 25 is deenergized is suppressed to a value lower than the predetermined duty ratio at which the solenoid 25*a* of the second actuator 25 is energized, thereby avoiding any possible hunting of the second actuator 25 which would occur when the second actuator 25 is operated approximately at the predetermined duty ratio. The hysteresis characteristic referred to above is determined by a resistance R. Where this anti-hunting circuit 38 is to be employed, this circuit 38 should be inserted between the drive circuit 37 for the second actuator 25 and the solenoid 25*a* of the second actuator 25 as best shown in FIG. 5. In FIG. 6, the relationship between the air-fuel ratio control signal, the command signal from the drive circuit 37 and an output signal from the anti-hunting circuit 38, the respective waveforms of which are shown by (a), (b) and (c), is shown.

In addition, as shown by the phantom line in FIG. 3, an additional adder circuit 39 may be interposed between the drive circuit 37 for the second actuator 25 and the adder circuit 33 so that, when the solenoid 25*a* of the second actuator 25 is energized and deenergized, the duty ratio of the first actuator 24 can be reduced and increased, respectively. By the employment of the additional adder circuit 39 in the manner as shown by the phantom line in FIG. 3, a more accurate adjustment of the air-fuel mixing ratio can be achieved with the minimized range of variation.

Figure 7:
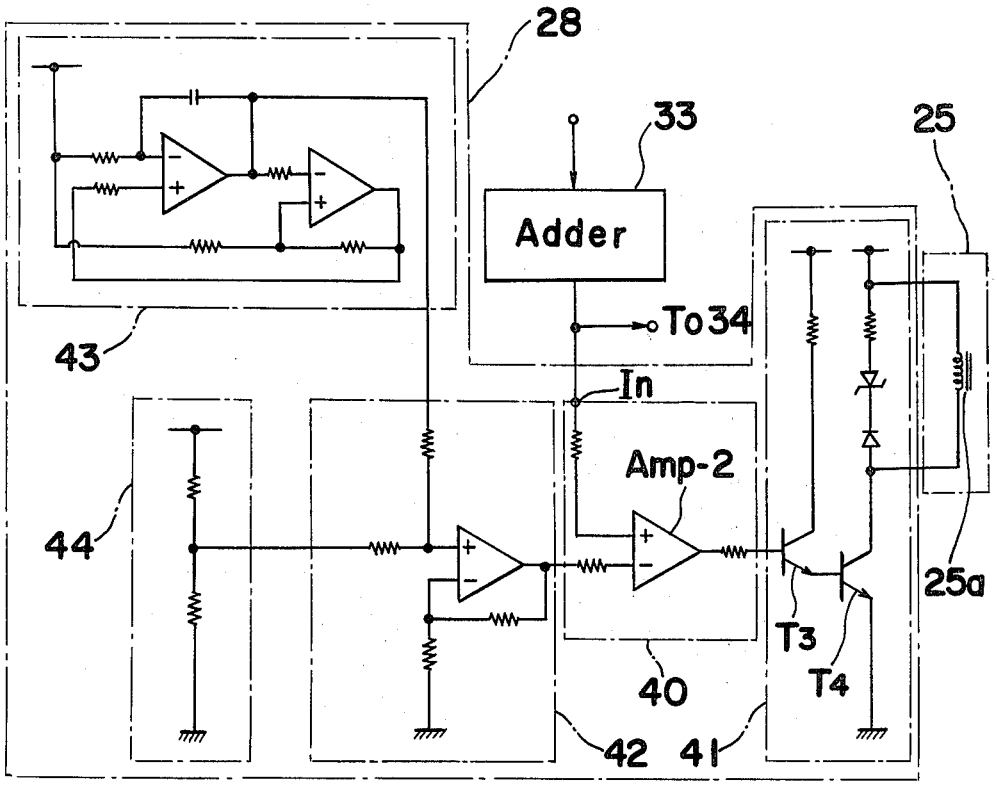
FIG. 7 is a circuit diagram showing a portion of the control system according to a second preferred embodiment of the present invention.
Figure 8A:
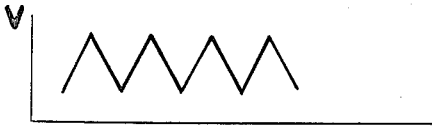
FIG. 8(*a*) is a diagram showing a waveform of an output signal from a sawtooth wave generator shown in FIG. 7.
Figure 8C:
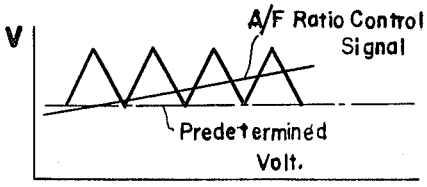
Figure 8B:
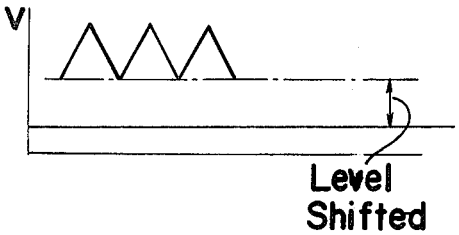
Figure 8D:
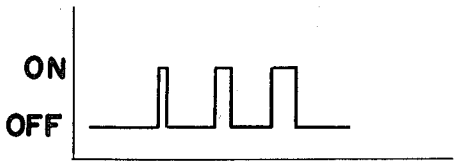

The air bleed control circuitry 28 shown in FIG. 7 is so designed that the second actuator 25 which is opened when the duty ratio of the first actuator 24 exceeds the predetermined value can be controlled according to the duty ratio to control the flow of air through the second auxiliary air bleed passage 23.

Referring now to FIG. 7, the air bleed control circuitry 28 shown therein comprises a duty ratio control circuit 40 having an output terminal connected to the solenoid 25*a* of the second actuator 25 through a drive circuit 41 and a pair of input terminals, one of said input terminals being connected to the adder circuit 33 (FIG. 3) while the other of said input terminals of the control circuit 40 is connected through an adder circuit 42 to both a sawtooth wave generator 43 and a level setting circuit 44.

In this construction, the output signal from the adder circuit 42 which represents the sawtooth wave signal from the generator 43 which has been increased in level as shown in FIG. 8(*b*) by being superimposed on an output signal from the level setting circuit 44, is supplied to an inverting input terminal of a differential amplifier Amp-2 forming a part of the duty ratio control circuit 40. On the other hand, the air-fuel ratio control signal from the adder circuit 33 is supplied to a non-inverting input terminal of the differential amplifier Amp-2. An output signal from the duty ratio control circuit 40, the waveform of which is shown in FIG. 8(*d*), is supplied through a third switching transistor T3 to a fourth switching transistor T4 which has its collector connected to the solenoid 25*a* of the second actuator 25.

As shown in FIG. 8(*b*), in the adder circuit 42, the sawtooth wave signal from the sawtooth wave generator 43, the waveform of which is shown in FIG. 8(*a*), is superimposed on the output signal from the level setting circuit 44, the level of said output signal from the level setting circuit 44 corresponding to the predetermined or desired duty ratio, such that the sawtooth wave signal is shifted in level by an increment determined by the level of the output signal from the level setting circuit 44. The sawtooth wave signal so treated in the adder circuit 42 is subsequently fed to the duty ratio control circuit 40 together with the air-fuel ratio control signal from the adder circuit 33 (FIG. 3). As shown in FIG. 8(*c*), the air-fuel ratio control signal from the adder circuit 33 has its voltage so increasing as to cause the first actuator 24 to open to make the combustible mixture being supplied to the engine E leaner. As can readily be understood from FIG. 8(*d*), the differential amplifier Amp-2 of the duty ratio control circuit 40 compares the air-fuel ratio control signal from the adder circuit 33 with the sawtooth wave signal fed from the sawtooth wave generator 43 through the adder circuit 42 whereby the duty ratio control circuit 40 generates its output signal in the form of pulses of varying duration when the sawtooth wave signal fed thereto from the adder circuit 42 exceeds the predetermined duty ratio. The pulses from the duty ratio control circuit 40 are in turn applied to the base of the third transistor T3 of drive circuit 41 to switch the latter on, the fourth transistor T4 of drive circuit 41 being so switched on in response to the switching-on of the third transistor T3 to energize the solenoid 25*a* of the second actuator 25. Accordingly, it is clear that the second actuator 25 is opened in dependence on the predetermined duty ratio to permit the supply of air through the second auxiliary air bleed passage 23 past the second actuator 25, thereby increasing the amount of air drawn into the main fuel supply passage 19 in the carburetor 10. By so doing, the combustible mixture then enriched with respect to the stoichiometric air-fuel mixing ratio can be made leaner, that is, adjusted so as to have an air-fuel mixing ratio equal to or substantially equal to the stoichiometric value.

From the foregoing description of the present invention, it has now become clear that, because of the provision of the additional air bleed control system including the air bleed control circuitry 28, the second actuator 25 and the second auxiliary air bleed passage 23, which is effective to increase the amount of air to be premixed with the fuel in the main fuel supply passage 19 when the duty ratio of the first actuator 24 attains the predetermined duty ratio, not only can a relatively wide range of control of the amount of air to be premixed with the fuel be achieved, but also the air-fuel mixing ratio of the combustible mixture being supplied to the engine can be substantially maintained at a stoichiometric value even when the engine E is operated at a high altitude and/or under an elevated ambient temperature. By maintaining the air-fuel mixing ratio of the combustible mixture, the catalytic converter can work at its maximum conversion efficiency and, accordingly, a substantial purification of the automobile exhaust gases can be achieved.

Although the present invention has fully been described in connection with the preferred embodiments thereof with reference to the accompanying drawings, it is to be noted that various changes and modifications are apparent to those skilled in the art. By way of example, although the use of the separate first and second auxiliary air bleed passages 22 and 23 has been referred to in this specification, it is to be noted that one of the first and second passages 22 and 23 may be a passage portion branched off from the other of the first and second passages 22 and 23.

In addition, although the present invention has been described as applied to the main fuel supply system of the automobile carburetor, it can equally be applicable to the known low speed fuel supply passage.

Accordingly, such changes and modifications are to be understood as included within the true scope of the present invention as defined by the appended claims, unless they depart therefrom.

I claim:

1. An air-fuel ratio control system for providing a required amount of air to a carburetor of an internal combustion engine, the carburetor having fuel passage means, including a fuel passage and means for receiving air from the atmosphere into the fuel passage, mixing fuel from the fuel passage with the air for forming a combustible air-fuel mixture, which air-fuel ratio control system comprises:

a catalytic convertor installed on an exhaust passageway leading from the engine to the atmosphere;

means, including a composition sensor provided on the exhaust passageway at a location between the engine and the catalytic convertor, for sensing, and producing a first output signal proportional to, the concentration of a component contained in exhaust gases emitted from the engine, which concentration is a function of the air-fuel mixing ratio of the combustible mixture combusted in the engine;

first air passage means, communicating with the fuel passage, for feeding air from the atmosphere to the fuel passage;

first actuator means for controlling the flow of air fed into the fuel passage through said first air passage means;

means, responsive to said first output signal, for producing a second output signal representative of an amount of air required in said fuel passage to obtain a desired air-fuel ratio of said air-fuel mixture;

duty ratio control means, responsive to said second output signal, for controlling the duty ratio of said first actuator means;

second air passage means, communicating with the atmosphere, for feeding additional air from the atmosphere to the fuel passage;

second actuator means for opening and closing said second air passage means for controlling the flow of additional air fed into the fuel passage by said second air passage means; and air bleed control means, responsive to said second output signal, for controlling said second actuator means to open said second air passage means to permit the flow of air to the fuel passage through said second air passage means together with the air flowing through said first air passage means when said second signal reaches a level indicating that the required amount of air exceeds a predetermined value.

2. A control system as in claim 1, wherein said second output signal producing means comprises:

a comparator circuit for comparing said first output signal with a reference signal representative of a first predetermined duty cycle and for generating a third output signal indicative of the difference between said first output signal and said reference signal;

integrator circuit means, responsive to said third output signal, for providing a fourth output signal of a wave form which is substantially the time integral of the wave form of said third output signal;

proportionating circuit means, responsive to said third output signal, for providing a fifth output signal proportional to said third output signal;

a first adder circuit for summing said fourth output signal and said fifth output signal, said second output signal being indicative of the sum of said fourth and fifth output signals, said first adder circuit providing said second output signal;

a first sawtooth wave generating circuit means for generating a first sawtooth wave signal, said duty ratio control means including a first duty ratio control circuit, responsive to said first sawtooth wave signal and said second output signal, for producing a sixth output signal determinative of the duty ratio of said first actuator means; and a first drive circuit, responsive to said sixth output signal, for driving said first actuator means according to the duty cycle determined by said first duty ratio control circuit, to permit the flow of air to the fuel passage means through said first air passage means.

3. A control system as in claim 2, wherein said air bleed control means comprises a duty ratio detecting circuit, coupled to said first adder circuit, for detecting said second output signal and for generating an output pulse when said second output signal reaches a level indicating that the duty ratio of said first actuator means exceeds said predetermined value, and a second drive circuit, responsive to said output pulse, for driving said second actuator means with a drive signal to permit the flow of air to said fuel passage means through said second air passage means, thereby increasing the amount of air premixed with the fuel from the fuel passage means.

4. A control system as in claim 3, wherein said air bleed means also comprises an anti-hunting circuit, coupled between said second drive circuit and said second actuator means, for imparting a hysteresis characteristic to said drive signal generated from said second drive circuit.

5. A control system as in claim 3, wherein said integrator circuit means and said proportionating circuit means have outputs coupled to the input of said first adder circuit, said control system further comprising a second adder circuit, coupling said second drive circuit to the input of said first adder circuit and said outputs of said integrator circuit means and said proportionating circuit means, for respectively decreasing and increasing the duty ratio of said first actuator means when said second air passage means is opened and closed by said second actuator means.

6. A control system as in claim 2, wherein said air bleed control means comprises second sawtooth wave generating circuit means for generating a second sawtooth wave signal; level setting circuit means for generating a seventh output signal indicative of a second predetermined duty ratio for the second actuator means; a third adder circuit, responsive to said second sawtooth wave signal and said seventh output signal, for generating an eighth output signal indicative of the sum of said second sawtooth wave signal and said seventh output signal; a second duty ratio control circuit, responsive to said second output signal and said eighth output signal, for producing an output pulse determinative of the duty ratio of said second actuator means when said eighth output signal exceeds said second predetermined duty ratio; and a third drive circuit, responsive to said output pulse, for driving said second actuator means according to the duty ratio determined by said second duty ratio control circuit to permit the flow of air to the fuel passage means through said second air passage means.

7. A control system as claimed in claim 1, 2, 3, 4, 5 or 6, wherein said fuel passage means is a main fuel supply passage in the carburetor.

8. A control system as claimed in claim 1, 2, 3, 4, 5 or 6, wherein said fuel passage means is a low speed fuel supply passage in the carburetor.

9. An air-fuel ratio control system for providing a required amount of air to a carburetor of an internal combustion engine, the carburetor having fuel passage means, including a fuel passage and means for receiving air from the atmosphere into the fuel passage for mixing fuel received in the fuel passage with the air for forming a combustible air-fuel mixture, which air-fuel ratio control system comprises:

a catalytic converter installed on an exhaust passageway leading from the engine to the atmosphere;

means, including a composition sensor provided on the exhaust passageway at a location between the engine and the catalytic converter, for sensing and producing a first output signal, proportional to the concentration of a component contained in exhaust gases emitted from the engine, which concentration is a function of the air-fuel mixing ratio of the combustible mixture combusted in the engine;

first air passage means, communicating with the fuel passage, for feeding air from the atmosphere to the fuel passage;

first actuator means for controlling the flow of air fed into the fuel passage by said first air passage means;

means, responsive to said first output signal, for producing a second output signal representative of a desired duty ratio;

duty ratio control means, responsive to said second output signal, for controlling the duty ratio of said first actuator means such that the duty ratio of said first actuator means equals said desired duty ratio;

second air passage means, communicating with the atmosphere, for feeding air from the atmosphere to the fuel passage;

second actuator means for controlling the flow of air fed into the fuel passage by said second air passage means; and air bleed control means, responsive to said second output signal, for controlling said second actuator means to open said second air passage means to permit the flow of air to the fuel passage means through said second air passage means together with the air flowing through said first air passage means when said second signal reaches a level indicating that said required amount of air exceeds a predetermined value.

10. An air-fuel ratio control system for providing a required amount of air to a carburetor of an internal combustion engine, the carburetor having fuel passage means, including a fuel passage and means for receiving air from the atmosphere into the fuel passage for mixing the fuel received in the fuel passage with the air for forming a combustible air-fuel mixture, which air-fuel ratio control system comprises:

a catalytic converter installed on an exhaust passageway leading from the engine to the atmosphere;

means, including a composition sensor provided on the exhaust passageway at a location between the engine and the catalytic converter, for sensing, and producing a first output signal proportional to, the concentration of a component contained in exhaust gases emitted from the engine, which concentration is a function of the air-fuel mixing ratio of the combustible mixture combusted in the engine;

first air passage means, communicating with the fuel passage, for feeding air from the atmosphere to the fuel passage;

first actuator means for controlling the flow of air fed into the fuel passage by said first air passage means;

means, responsive to said first output signal, for producing a second output signal representative of a desired duty ratio;

duty ratio control means, responsive to said second output signal, for controlling the duty ratio of said first actuator means such that the duty ratio of said first actuator means equals said desired duty ratio;

second air passage means, communicating with the atmosphere, for feeding air from the atmosphere to the fuel passage;

second actuator means for controlling the flow of air fed into the fuel passage by said second air passage means; and air bleed control means, responsive to said second output signal, for controlling said second actuator means to open said second air passage means to permit the flow of air to the fuel passage means through said second air passage means together with the air flowing through said first air passage means when said second output signal reaches a level indicating that said desired duty ratio exceeds a predetermined value.

* * * * *